US006360891B1

(12) United States Patent
Rideout

(10) Patent No.: US 6,360,891 B1
(45) Date of Patent: Mar. 26, 2002

(54) ILLUMINATED TOOL ORGANIZER APPARATUS AND METHOD

(76) Inventor: Jay B. Rideout, 507 Union, Steilacoom, WA (US) 98388

( * ) Notice: Subject to any disclaimer, the term of this patent is extended or adjusted under 35 U.S.C. 154(b) by 0 days.

(21) Appl. No.: 09/658,285

(22) Filed: Sep. 8, 2000

Related U.S. Application Data

(60) Provisional application No. 60/153,103, filed on Sep. 9, 1999.

(51) Int. Cl.[7] ..... B65D 85/00

(52) U.S. Cl. ..... 206/373; 206/372; 362/154

(58) Field of Search ..... 206/349, 372, 206/373; 211/70.6; 362/154, 156; 220/735

(56) References Cited

U.S. PATENT DOCUMENTS

| | | | | | |
|---|---|---|---|---|---|
| 5,350,065 | A | * | 9/1994 | Darrey | 206/373 |
| 5,379,885 | A | * | 1/1995 | Chen | 206/216 |
| 5,836,446 | A | * | 11/1998 | Varnom | 206/373 |
| 5,879,072 | A | * | 3/1999 | Huang | 362/156 |
| 6,105,768 | A | * | 8/2000 | Brown | 206/373 |
| 6,283,292 | B1 | * | 9/2001 | Chen | 206/373 |

* cited by examiner

*Primary Examiner*—David T. Fidei

(57) ABSTRACT

An illuminated tool organizer is provided to illuminate tools in dark or dimly lighted areas. For this purpose, the tool organizer is arranged for receiving and securing a flashlight, or other portable light source, in a position to illuminate portions of the tool organizer. The illuminated tool organizer includes an upper rack that defines a plurality of openings to receive tools for supporting the same from the upper rack. In addition, a lower base defining a base platform from which to support tools thereon is disposed below the upper rack. To fix the upper rack in spaced relation to the lower base, a support structure is provided to extend upward from the lower base to the upper rack to fix the same at a predetermined elevation above the lower base. In order to receive and secure a flash light in either a horizontal or vertical position, a cradle is disposed adjacent the upper rack. The cradle is formed to define an opening for receiving a flashlight in an upright substantially vertical position. With this arrangement, the flashlight is movable from a first stored position where portions thereof extend downward through the opening, to a second operating position where the flashlight is supported in an upright position, above the upper rack, such that light from the illuminating end of the flashlight is directed downward to illuminate the region between the upper rack and the lower base.

20 Claims, 3 Drawing Sheets

ILLUMINATED TOOL ORGANIZER APPARATUS AND METHOD

This application claims the benefit of U.S. Provisional Application No. 60/153,103 Filed Sep. 9, 1999.

BACKGROUND

This invention relates generally to tool organizers arranged for storing an assortment of tools, and more particularly to such tool organizers arranged to accommodate a source of illumination.

A number of devices have been invented for organizing and storing tools. For example U.S. Pat. No. 4,826,007 issued in 1989 to Skeie discloses a tool bucket organizer usable with a tool bucket having a flange-like configuration about the perimeter of the bucket and including a cylindrical aperture to provide access to the interior of the bucket. Similarly U.S. Pat. No. 4,826,007 issued in 1990 to Venegoni discloses a bucket organizer tray having a plurality of like stackable organizer trays sized to fit within a bucket.

In contrast, U.S. Pat. No. 5,088,014 issued in 1992 to Boughey discloses a tool caddy with an adjustable light boom. Some other designs include U.S. Pat. No. 5,261,561 issued in 1993 to Hodges disclosing a bucket organizer device for seating atop a pail. Moreover, U.S. Pat. No. 5,437,369 issued in 1995 to Spitere discloses a tool bucket having a handle that serves the purpose of locking tools to the container.

Although the above noted prior art tool bucket organizers, disclose various designs for storing and organizing tools, they typically are not directed to, or teach a simple tool organizer arranged to illuminate the tools therein or the surrounding area with a readily available portable light source.

Accordingly, a need remains for an inexpensive tool organizer arranged to support a source of illumination, such as a flashlight, in various positions to illuminate the tool organizer and the tools therein as well as providing a storage for the light source/flashlight.

SUMMARY

One object of the invention is to enable a person to quickly locate the proper tool from a tool organizer situated in a dimly lighted area.

A second object of the invention is to easily position a flashlight or other portable source of light to illuminate the area adjacent the tool organizer.

Another object is to support a light source or flashlight such that the illumination therefrom illuminates portions of the tool organizer.

Yet another object of the invention is to create storage within the tool organizer for a portable light source or flashlight.

A further object is to minimize the time it takes to locate the proper tool in the tool organizer.

Still another object is to removably secure a portable illuminated tool organizer within a standard 5 gallon container.

The invention is an illuminated tool organizer provided to enable a user thereof to easily identify tools in dark or dimly lighted situations and/or areas. For this purpose, the tool organizer is arranged for receiving and securing a flashlight, or other portable light source, in a position to illuminate portions of the tool organizer. The illuminated tool organizer includes an upper rack that defines a plurality of openings to receive tools for supporting and suspending the same from the upper rack. In addition, a lower base defining a base platform from which to support tools thereon is disposed below the upper rack. As will be more fully explained in the detailed specification, in the preferred embodiment, the base platform defines a support surface having a boundary lip to contain and prevent tools from slipping off the support surface.

Importantly, a support structure is provided to fix the upper rack in spaced relation to the lower base. Accordingly, the support structure extends upward from the lower base to the upper rack to fix the same at a predetermined elevation above the lower base.

In order to receive and secure a flashlight in either a horizontal or vertical position, a cradle is disposed adjacent the upper rack. In the present invention, the cradle is formed to define an opening for receiving a flashlight in an upright substantially vertical position. With this arrangement, the flashlight is movable from a first stored position where portions thereof extend downward through the opening, to a second operating position where the flashlight is supported in an upright position, above the upper rack, such that light from the illuminating end of the flashlight is directed downward to illuminate the region between the upper rack and the lower base.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENT

Figure 1:
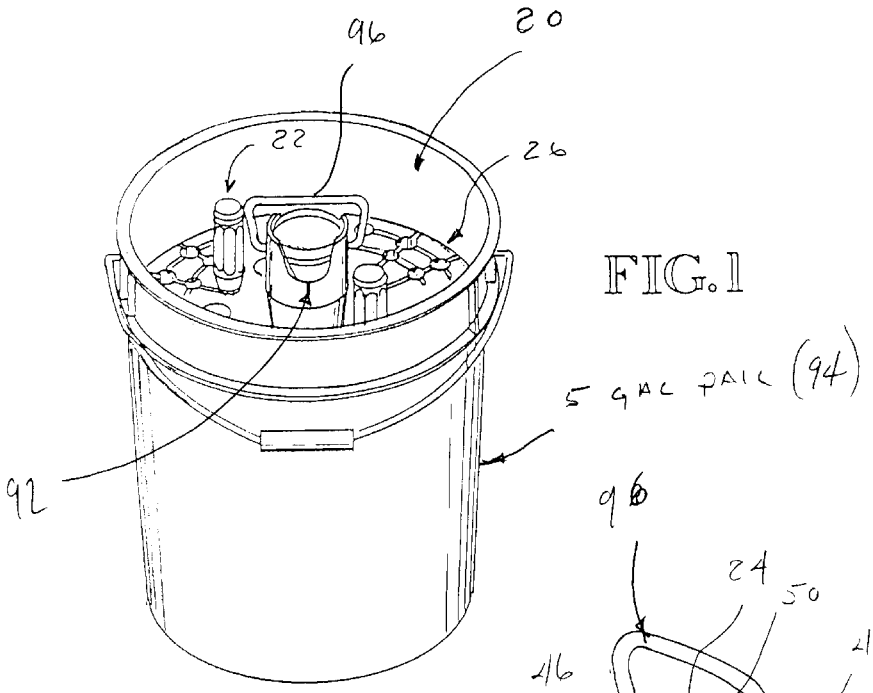
FIG. 1 is a front side perspective view of a illuminated tool organizer contained within a 5 gallon container wherein a flash light is disposed within the tool organizer in the first stored position.

Referring now to the illustrations, FIGS. 1 through 5 illustrate a preferred embodiment constructed in accordance with the present invention. The invention is an illuminated tool organizer 20 provided to enable a user thereof to easily identify tools 22 in dark or dimly lighted situations and/or areas. For this purpose, the tool organizer 20 is arranged for receiving and securing a flashlight 24 in a position to illuminate portions of the tool organizer 20. The illuminated tool organizer 20 includes an upper rack 26 that defines a plurality of openings 28 to receive tools 22 for supporting and suspending the same from the upper rack 26. In addition, a lower base 32 defining a base platform 34 from which to support tools 22 thereon is disposed below the upper rack 26. As will be more fully explained in the detailed specification, the preferred embodiment provides a base platform 34 that defines a support surface 36 having a boundary lip 38 to contain and prevent tools from slipping off the support surface 36. More specifically, the boundary lip 38 encompasses the support surface 36 to form a tool tray 40 for receiving and containing loose tools 22.

Importantly, a support structure 42 is provided to fix the upper rack 26 in spaced relation to the lower base 32. Accordingly, the support structure 42 extends upward from the lower base 32 to the upper rack 26 to fix the same at a predetermined elevation above the lower base 32.

In order to receive and secure a flashlight 24 in either a horizontal or vertical position, a cradle 44 is disposed above the upper rack 26. In the present invention, the cradle 44 is formed to define an opening 46 for receiving a flashlight 24 in an upright substantially vertical position. With this arrangement, the flashlight 24 is movable from a first stored position where portions thereof extend downward through the opening 46, to a second operating position where the flashlight is supported in an upright position, above the upper rack, such that light 48 from the illuminating end 50 of the flashlight 24 is directed downward to illuminate the region 52 between the upper rack 26 and the lower base 32.

Considering now in more detail the components from which a tool organizer 20 is constructed, in the preferred embodiment, the support structure 42 is tubular in shape and is centrally disposed between the lower base 32 and the upper rack 26. To maximize light transmission from the flashlight 24, for illuminating the lower base 32 and the adjacent region, the support structure 42 is constructed from translucent material. For this purpose, readily available translucent plastic (PVC) tubular material is employed therefor. As will be more fully explained below, the cradle 44 is integrally molded with the support structure 42. The process for so integrally molding the cradle 44 and the support structure 42 could include vacuum formed rotationally molded techniques, and/or injection molding methods.

In the preferred embodiment, the lower base 32 is fixed to the support structure 42 by a centrally disposed projecting support collar 54 that is integrally molded with the lower base 32. Although any number of acceptable manufacturing methods could be employed, rotomolded polyethylene is employed in the present invention. Importantly, the support collar 54 defines an inner bore 56 sized to firmly receive the tubular support structure 42 therein. For this purpose, the support collar 54 includes a radially disposed recessed groove 58. In this way, the support structure 42 can be securely fixed to the lower base 32 by placing glass filled polyester resin 60 within recessed groove 58.

As noted above, in the present invention, the lower base 32 includes a support surface 36 and an integrally molded boundary lip 38 to form a tool tray 40 for containing tools 22. For the purposes of this detailed specification, it should be noted that the tools 22 collectively include all tools that are illustrated in the drawings. Although this is a preferred construction, other arrangements could be practiced. For example, the lower base 32 could be constructed without a boundary lip 38 (not illustrated). Moreover, the support structure 42 could be constructed with components disposed on the radially outer edges of the lower base 32 (not illustrated) extending upward to the upper rack 26.

Figure 2:
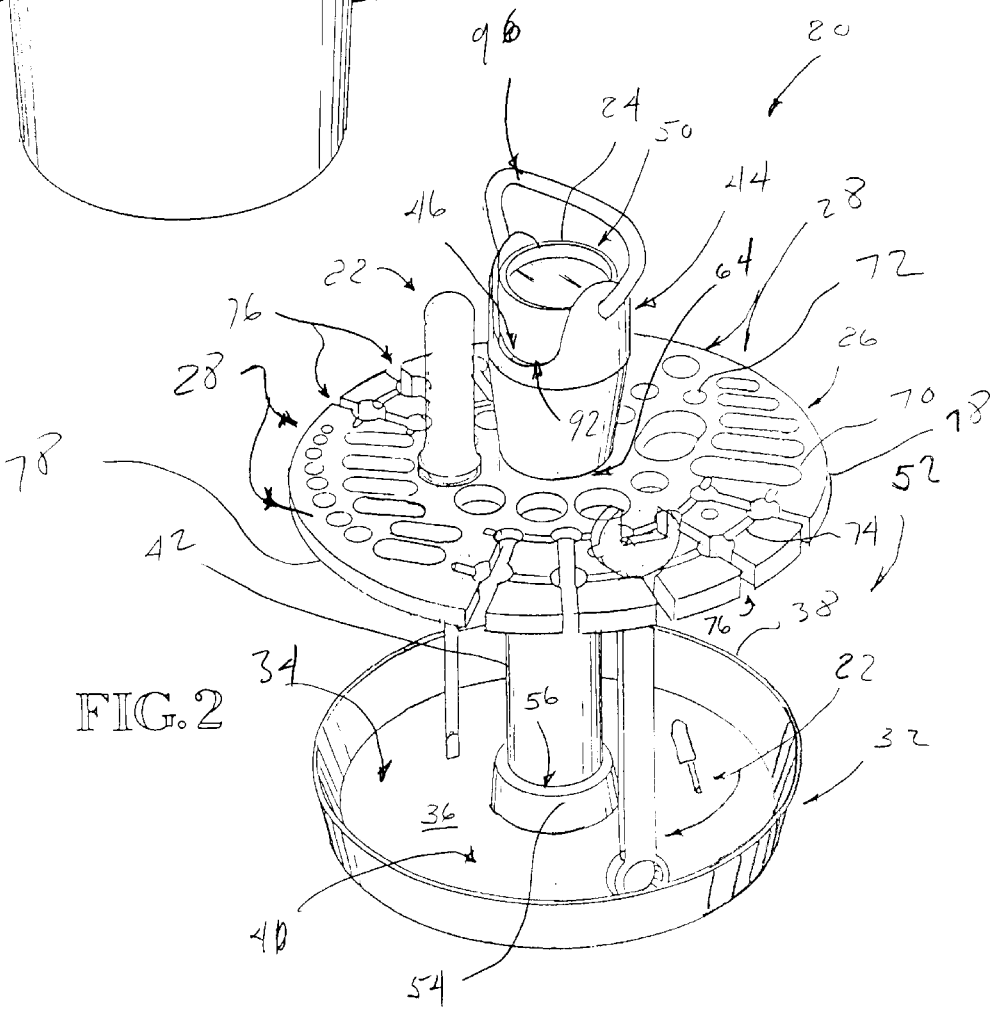
FIG. 2 is a perspective view of an illuminated tool organizer in accordance with the preferred embodiment wherein a flash light is disposed within the tool organizer in the first stored position.
Figure 3:
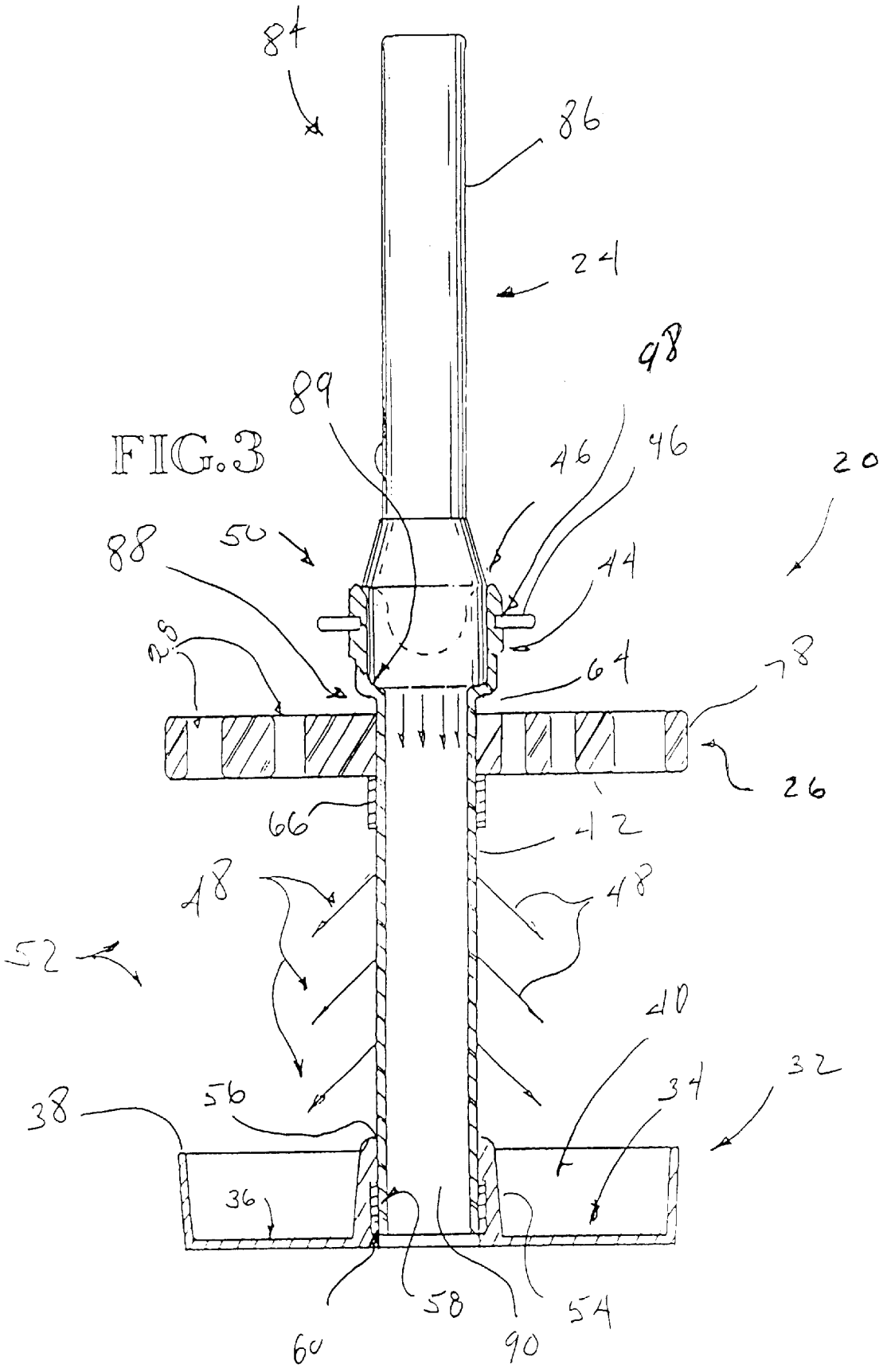
FIG. 3 is an elevational view of an illuminated tool organizer wherein a flash light is secured in the cradle, disposed in the second upright operating position to illuminate the region between the upper rack and lower base.
Figure 4:
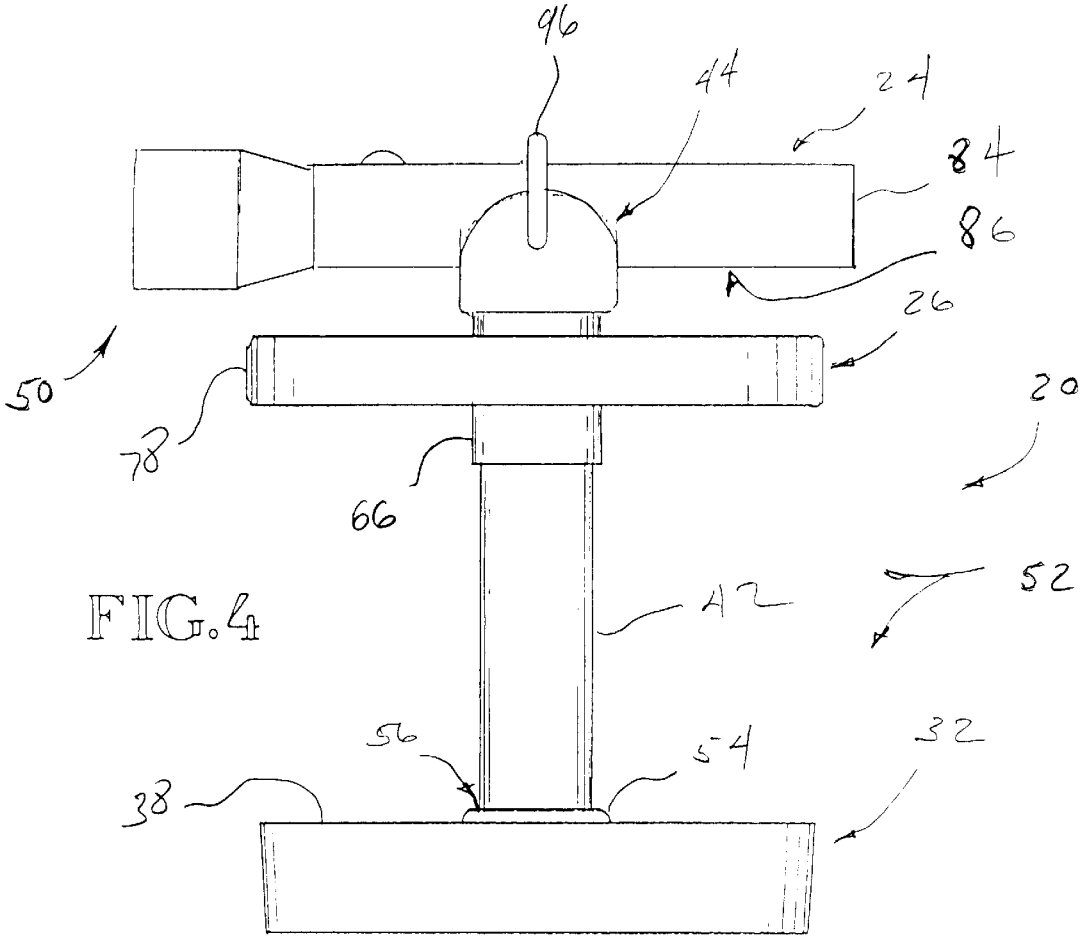
FIG. 4 is an elevational view of an illuminated tool organizer wherein a flash light is disposed in an alternate horizontal position upon a cradle where the flash light can illuminate areas away from the illuminated tool organizer.
Figure 5:
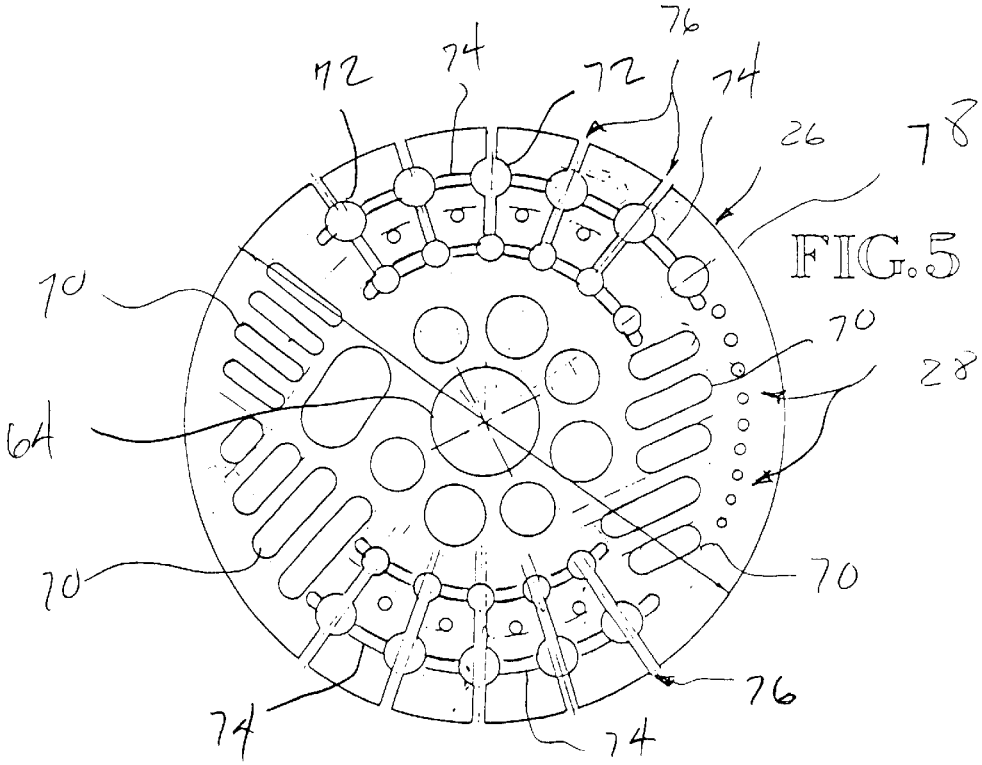
FIG. 5 is an over head plan view illustrating the arrangement of openings and grooves defined by the upper rack.

Directing attention to FIGS. 2 and 3, the upper rack 26 is spaced upward from the lower base 32. To facilitate the connection between the upper rack 26 and the support structure 42, a centrally disposed bore 64 is provided in the upper rack 26. Accordingly, the support structure 42 is positioned through bore 64 prior to attaching the lower base 32. In addition, a sleeve 66 is disposed below the upper rack 26, about the support structure 42. The sleeve 66 is welded to the support structure 42, in a location to properly position and support the upper rack 26. Thus, the upper rack 26 rests upon sleeve 66. radial Explaining in more detail, upper rack 26 comprises a plurality of tool openings 28 in the form of slots 70 and bores 72 of various sizes. Additionally, semi-circular shaped grooves 74 are formed to extend between bores 72. The grooves 74 are so provided to create a depressed surface to maintain the tools in proper position and to prevent the same from sliding out of the bores 72. Importantly, the upper rack 26 of the present invention includes a pattern of slots 70 and bores 72 as illustrated best in FIG. 5. It should be noted, however, that many alternate patterns of the same (not illustrated) could be employed with equally satisfactory results for tool support and organization. Additionally, a plurality of radially disposed access slots 76 extend inward from the outer edge 78 of the upper rack 26 to a plurality of bores 72. In this way, a user can quickly and easily move tools horizontally into position for support by the upper rack 26. Further, it should be understood that the material employed for the upper rack 26 is similarly a PVC or plastic molded to the proper shape to define the above noted bores 72 slots 70 and grooves 74. However, any other rigid or semi-rigid material that can be shaped or molded, including wood, could be used to construct the upper rack 26.

Turning again to FIGS. 1, 2 and 3, a cradle 44 is illustrated supporting a flash light 24. As noted above, the cradle 44 is integrally formed with the support structure 42. Although the present invention calls for this construction, the cradle 44 could be constructed as a separate part (not illustrated) to be joined with either the support structure 42, or with the upper rack 26. Importantly the cradle 44 comprises an opening 46 which is sized to receive the enlarged illuminating end 50 of a Mag-Lite™ style flashlight 24. Similar to most commercially available flashlights, the Mag-Lite™ style flashlight comprises a long battery-holding tubular portion 86 having a diameter which is smaller than that of the enlarged illuminating end 50. As will be more fully explained below, the cradle 44 is constructed to secure the illuminating end 50 of a flashlight above the upper rack 26.

For this purpose, a step 88 is formed to create a radially outer surface 89 thereby providing a transition between the cradle 44 and the support structure 42. The step 88 forms a reduced diameter passage 90 through which the tubular portion 86 of a flashlight can extend downward through the support structure 42. Accordingly, the cradle 44 can secure a flashlight such that the illuminating end 80 is directed downward (FIG. 3), i.e., the second operating position, or alternately with the illuminating end 80 directed upward (FIG. 1), i.e., the first stored position where the tubular portion 86 of the flashlight 24 can extend. Additionally, it should be noted that the cradle 44 could be simply be constructed as a step, i.e., step 88 thereby forming a surface to engage a flashlight 24.

Further, the cradle 44 comprises opposing recessed portions 92 that are shaped to receive the tubular portion 86 of a flashlight 24 in a horizontal position. Accordingly, a flashlight 24 can be received by the cradle 44 such that the illuminating end 50 is directed either horizontally, or vertically. It should be understood that the term flashlight is used herein to define an self contained portable source of light. Moreover, with regard to a preferred embodiment, the typical construction for a flashlight comprises an illuminating end 50 which is somewhat larger that the tubular portion 86 which extends therefrom. However, other embodiments (not illustrated) could be designed to work with flashlights constructed of various other shapes (not illustrated).

Finally, the construction of the components of the present invention are sized and shaped such that the tool organizer 20 will fit within a typical round 5 gallon container 94. Accordingly, in a preferred embodiment, the upper rack 26 and the lower base 32/tool tray 40 are round in shape thereby maximizing the area of the same. Similarly, the height of the tool organizer 20 is equal to or less than that of a 5 gallon container 94.

In addition, a handle 96 is attached to the cradle 44 so that the tool organizer 20 can be easily lifted from the five gallon container 94. The handle 96 is formed from metal rod bent and shaped to attach to cavities 98 formed in opposing sides of the cradle 44. In this way, the handle 96 can pivot out of the way to allow the flashlight to extend upward in the operating position.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. An illuminated tool organizer arranged for receiving and securing a flashlight in a position to illuminate areas adjacent the tool organizer and the tools secured therein, the tool organizer comprising:

an upper rack defining a plurality of openings for receiving and supporting tools from the upper rack;

a lower base;

a support structure extending upward from the lower base to the upper rack to fix the upper rack in spaced relation to the lower base;

a cradle disposed adjacent the upper rack for receiving and engaging a flashlight, the cradle defining an opening for receiving a flashlight in an upright substantially vertical position; and wherein the flashlight is movable from a first stored position where portions thereof extend downward through the cradle and through the opening, within the support structure, to a second operating position where the flashlight is supported by the cradle substantially above the support structure.

2. A tool organizer as recited in claim 1 wherein the flashlight is movable from a first stored position where portions thereof extend downward through the cradle and through the opening, to a second operating position where the flashlight is supported by the cradle in an upright position substantially above the upper rack such that light from the flashlight is directed through the opening downward to illuminate the region between the upper rack and the lower base.

3. A tool organizer as recited in claim 1 wherein the cradle extends upward from the upper rack for receiving the flashlight in a substantially horizontal position such that the light from the flashlight is directed outward from the tool organizer.

4. A tool organizer as recited in claim 3 wherein the cradle is arranged to define opposing recessed portions to receive and hold a flashlight in a horizontal position.

5. A tool organizer as recited in claim 2 wherein the cradle defines a step for receiving and engaging the flashlight in the upright, substantially vertical position.

6. A tool organizer as recited in claim 1 wherein the lower base defines a base platform from which to support tools thereon.

7. A tool organizer as recited in claim 6 wherein the base platform defines a support surface and a boundary lip disposed to contain tools on the support surface.

8. A tool organizer as recited in claim 1 wherein the support structure is defined by a centrally disposed translucent enclosure.

9. A tool organizer as recited in claim 8 wherein the support structure is tubular.

10. A tool organizer as recited in claim 1 further comprising a handle arranged to engage the cradle so that a user can lift the tool organizer by the handle.

11. A tool organizer as recited in claim 1 wherein the upper rack and the lower base are circular in shape such that the same can be positioned within a standard 5 gallon container.

12. A tool organizer as recited in claim 1 wherein the cradle is integrally formed with support structure that extends upward from the lower base.

13. A method for making an illuminated tool organizer arranged for receiving and securing a flashlight in a position to illuminate portions of the tool organizer and the tools secured therein, comprising the steps:

forming an upper rack to define a plurality of openings for receiving and supporting tools from the upper rack;

providing a lower base;

operatively positioning a support structure to extend upward from the lower base to the upper rack to fix the upper rack in spaced relation to the lower base;

providing a cradle disposed adjacent the upper rack for receiving and engaging a flashlight, the cradle defining an opening for receiving a flashlight in an upright substantially vertical position; and wherein the flashlight is movable from a first stored position where portions thereof extend downward through the cradle and through opening, within the support structure, to a second operating position where the flashlight is supported by the cradle substantially above the support structure.

14. A method as recited in claim 13 further comprising the step of arranging the cradle such that the flashlight is movable from a first stored position where portions thereof extend downward through the cradle and through the opening, to a second operating position where the flashlight is supported by the cradle in an upright position substantially above the upper rack such that light from the flashlight is directed through the opening downward to illuminate the region between the upper rack and the lower base.

15. A method as recited in claim 13 further comprising the step of arranging the cradle to define opposing recessed portions to receive and hold a flashlight in a horizontal position.

16. A method as recited in claim 13 further comprising the step of arranging the cradle to define a step for receiving and engaging the flashlight in the upright, substantially vertical position.

17. A method as recited in claim 13 further comprising the step of arranging the base to define a base platform from which to support tools thereon.

18. An illuminated tool organizer arranged for receiving and securing a flashlight in a position to illuminate areas adjacent the tool organizer, the tool organizer comprising:

an upper rack defining a plurality of openings for supporting and suspending tools therefrom;

a lower base defining a storage space for receiving tools;

a support structure extending upward from the lower base to the upper rack to fix the upper rack in spaced relation to the lower base;

a cradle defined by the upper rack for receiving a flashlight, the cradle defining an opening for supporting a flashlight in an upright position, wherein the flashlight is movable from a first storage position where portions thereof extend downward through the opening, to a second operating position where the flashlight is supported in an upright position above the upper rack such that light from the flashlight is directed through the opening downward to illuminate the region between the upper rack and the lower base.

19. A tool organizer as recited in claim 18 wherein the cradle extends upward from the upper rack for receiving the flashlight in a substantially horizontal position such that the light from the flashlight is directed outward from the tool organizer.

20. A tool organizer as recited in claim 18 wherein the cradle is arranged to define opposing recessed portions to receive and hold a flashlight in a horizontal position.

* * * * *